United States Patent [19]

Elsner et al.

[11] Patent Number: 4,557,074

[45] Date of Patent: Dec. 10, 1985

[54] METHOD AND APPARATUS FOR GRINDING UNDULATE CUTTING EDGES OF KNIVES IN TOBACCO CUTTING MACHINES

[75] Inventors: Uwe Elsner, Dassendorf; Werner Komossa, Börnsen, both of Fed. Rep. of Germany

[73] Assignee: Hauni-Werke Körber & Co. KG, Hamburg, Fed. Rep. of Germany

[21] Appl. No.: 630,389

[22] Filed: Jul. 13, 1984

[30] Foreign Application Priority Data

Jul. 16, 1983 [DE] Fed. Rep. of Germany ..... 3325751
Feb. 2, 1984 [DE] Fed. Rep. of Germany ..... 3403543

[51] Int. Cl.[4] ..... B24B 7/00

[52] U.S. Cl. ..... 51/5 D; 51/34 E; 51/36; 51/47; 51/249; 51/285

[58] Field of Search ..... 51/5 D, 285, 246, 247, 51/249, 34 E, 34 G, 47, 36

[56] References Cited

U.S. PATENT DOCUMENTS 2,691,251 10/1954 Rehse ..... 51/36
2,830,634 4/1958 Pollmann ..... 51/249
3,859,762 1/1975 Ludwig ..... 51/285

*Primary Examiner*—Frederick R. Schmidt
*Assistant Examiner*—J. T. Zatarga
*Attorney, Agent, or Firm*—Peter K. Kontler

[57] ABSTRACT

The undulate cutting edges of knives on a rotary knife holder in a tobacco shredding machine are ground by a grinding wheel whose profile is complementary to that of the cutting edges and which is moved stepwise in parallelism with the axis of the holder and thereupon radially or tangentially of the holder toward and from engagement with successive portions of the knives so that the grinding wheel treats a portion of a previously treated section and an untreated section of each knife while it is held close to the path of orbital movement of the knives. An advancing mechanism is provided to shift the grinding wheel stepwise in parallelism with the axis of the holder, and a moving mechanism is provided to displace the grinding wheel toward and away from the path of orbital movement of the knives during each interval between successive advances. The grinding wheel is dressed when it is out of contact with the knives, either by a rotary dressing tool, by a stationary dressing tool whose length at least matches the axial length of the grinding wheel, or by a stationary diamond.

25 Claims, 10 Drawing Figures

21
22
2
3
12
19
IV
IV
4
8
23
1a
9
1
11
7
16
14
12
17
18

119
112
102
104
139
108
103
136
137
150
123
133
131
134
138
109
101
129
111
107
114
116
118
112
117

METHOD AND APPARATUS FOR GRINDING UNDULATE CUTTING EDGES OF KNIVES IN TOBACCO CUTTING MACHINES

BACKGROUND OF THE INVENTION

The present invention relates to a method and apparatus for treating the knives in a tobacco cutting machine, particularly in a machine for shredding tobacco leaf laminae. More particularly, the invention relates to a method and apparatus for grinding the undulate cutting edges of knives in tobacco shredding and analogous tobacco cutting machines.

It is already known to shread tobacco leaf laminae by resorting to a rotary holder which supports a plurality of elongated knives having undulate cutting edges. Reference may be had to commonly owned U.S. patent application Ser. No. 561,177 filed Dec. 14, 1983 by Uwe Elsner. It is also known to grind the cutting edges of such knives by a grinding wheel having a working surface with a profile which is complementary to the outlines of undulate cutting edges. A drawback of presently known methods and apparatus of the above outlined character is that the grinding operation is unsatisfactory because the cutting edges cannot be ground at a frequency which is required to ensure the making of acceptable cuts as well as that the grinding unit occupies too much space and comprises an excessive number of bulky and expensive parts.

OBJECTS AND SUMMARY OF THE INVENTION

An object of the invention is to provide a novel and improved method of treating undulate cutting edges of knives in a tobacco cutting or shredding machine in such a way that the cutting edges are invariably in an optimum condition for the making of satisfactory cuts.

Another object of the invention is to provide a method which can be practiced with resort to a relatively simple, compact and inexpensive grinding apparatus.

A further object of the invention is to provide a method which ensures continuous optimum conditioning of undulate cutting edges of orbiting knives on the rotary holder of a tobacco cutting machine wherein a continuous cake of compacted tobacco leaf laminae is converted into shreds.

Still another object of the invention is to provide a novel and improved apparatus for the practice of the above outlined method and to construct the apparatus in such a way that it can continuously or substantially continuously treat the undulate cutting edge or edges of one or more orbiting knives in a tobacco cutting or shredding machine.

A further object of the invention is to provide an apparatus which can be utilised for continuous or substantially continuous grinding of undulate cutting edges of elongated knives in a tobacco cutting or shredding machine.

Another object of the invention is to provide the tobacco cutting apparatus with novel and improved means for continuously or substantially continuously dressing the profile of the grinding wheel in an apparatus of the above outlined character.

A further object of the invention is to provide the apparatus with novel and improved means or imparting movements to the grinding wheel or wheels in a predetermined sequence so as to ensure optimum conditioning of undulate cutting edges of knives in a tobacco shredding machine.

Another object of the invention is to provide the apparatus with novel and improved means for moving the grinding wheel or wheels relative to the dressing tool or tools.

One feature of the invention resides in the provision of a method of grinding the undulate cutting edge of a knife, which orbits along an endless (preferably circular) path about a predetermined axis in a tobacco cutting (preferably in a tobacco shredding) machine, by means of a rotating grinding wheel which is movable relative to the orbiting knife and has a profile that is complementary to that of the cutting edge. The method comprises the steps of advancing the grinding wheel stepwise relative to the orbiting knife and moving the profile of the grinding wheel into contact with different portions of the cutting edge between stepwise advancements of the grinding wheel. The advancing step can include shifting the grinding wheel in substantial parallelism with the predetermined axis. The moving step can include moving the grinding wheel toward and away from the orbiting knife at least substantially at right angles to the predetermined axis. Alternatively, the moving step can include moving the grinding wheel substantially tangentially of the endless path of orbital movement of the knife about the predetermined axis.

The moving step can include placing the grinding wheel into material-removing contact with a previously ground portion as well as with an untreated portion of the cutting edge. The extent of overlap between a previously ground portion of the cutting edge and the grinding wheel and a still untreated portion is preferably at least substantially the same upon completion of each moving step.

The method preferably further comprises the steps of dressing the grinding wheel during certain intervals between successive movements into contact with the orbiting knife. Each such dressing step can precede or follow a selected one of the advancing steps. The dressing step can include contacting the entire cutting edge of the knife with the complementary profile of a stationary or rotating dressing tool during each of the aforementioned intervals. Alternatively, the dressing step can include continuously moving the grinding wheel relative to the dressing tool, e.g., relative to a diamond.

Another feature of the invention resides in the provision of a machine for cutting (particularly shredding) tobacco or like fibrous materials. The machine comprises a holder, means for rotating the holder about a predetermined axis, at least one knife which is mounted on the holder for orbital movement along an endless path about the axis of the holder and has an elongated undulate cutting edge which extends in substantial parallelism with the axis of the holder, and means for grinding the cutting edge. The grinding means includes a rotary grinding wheel having an undulate profile which is complementary to that of the cutting edge, means for advancing the grinding wheel stepwise in substantial parallelism with the axis of the holder, and means for moving the grinding wheel into and from contact with the cutting edge between intermittent advances of the grinding wheel in parallelism with the axis of the holder.

The moving means can comprise a frame for the grinding wheel and means for displacing the frame at least substantially at right angles to the axis of the holder. The displacing means can comprise means for pivoting the frame, and such pivoting means can comprise an eccentric drive. Alternatively, the moving means can comprise means for moving the grinding wheel substantially tangentially of the endless path of the cutting edge about the axis of the holder.

The advancing means can comprise a reciprocable carriage and the moving means then preferably comprises a carrier for the grinding wheel. Such carrier is mounted in the carriage for pivotal movement about a second axis which is at least substantially parallel to the axis of the holder.

The advancing means can comprise a feed screw and means (e.g., a reversible electric stepping motor) for rotating the feed screw.

The machine preferably further comprises means for dressing the grinding wheel while the latter is out of contact with the cutting edge of the knife. The dressing means is preferably adjacent to one axial end of the holder. Such dressing means can comprise a tool the length of which at least matches the axial length of the grinding wheel so that all increments of the profile of the grinding wheel can be dressed in a simultaneous operation.

The dressing means can comprise a stationary dressing tool, such as an elongated block having a profile which is complementary to the profile of the grinding wheel. Alternatively, the dressing means can comprise a stationary diamond and at least one of the aforementioned advancing and moving means is then arranged to move the grinding wheel relative to the diamond.

The novel features which are considered as characteristic of the invention are set forth in particular in the appended claims. The improved machine itself, however, both as to its construction and its mode of operation, together with additional features and advantages of the improved grinding and dressing apparatus, will be best understood upon perusal of the following detailed description of certain specific embodiments with reference to the accompanying drawing.

DESCRIPTION OF THE PREFERRED EMBODIMENTS

Figure 1:
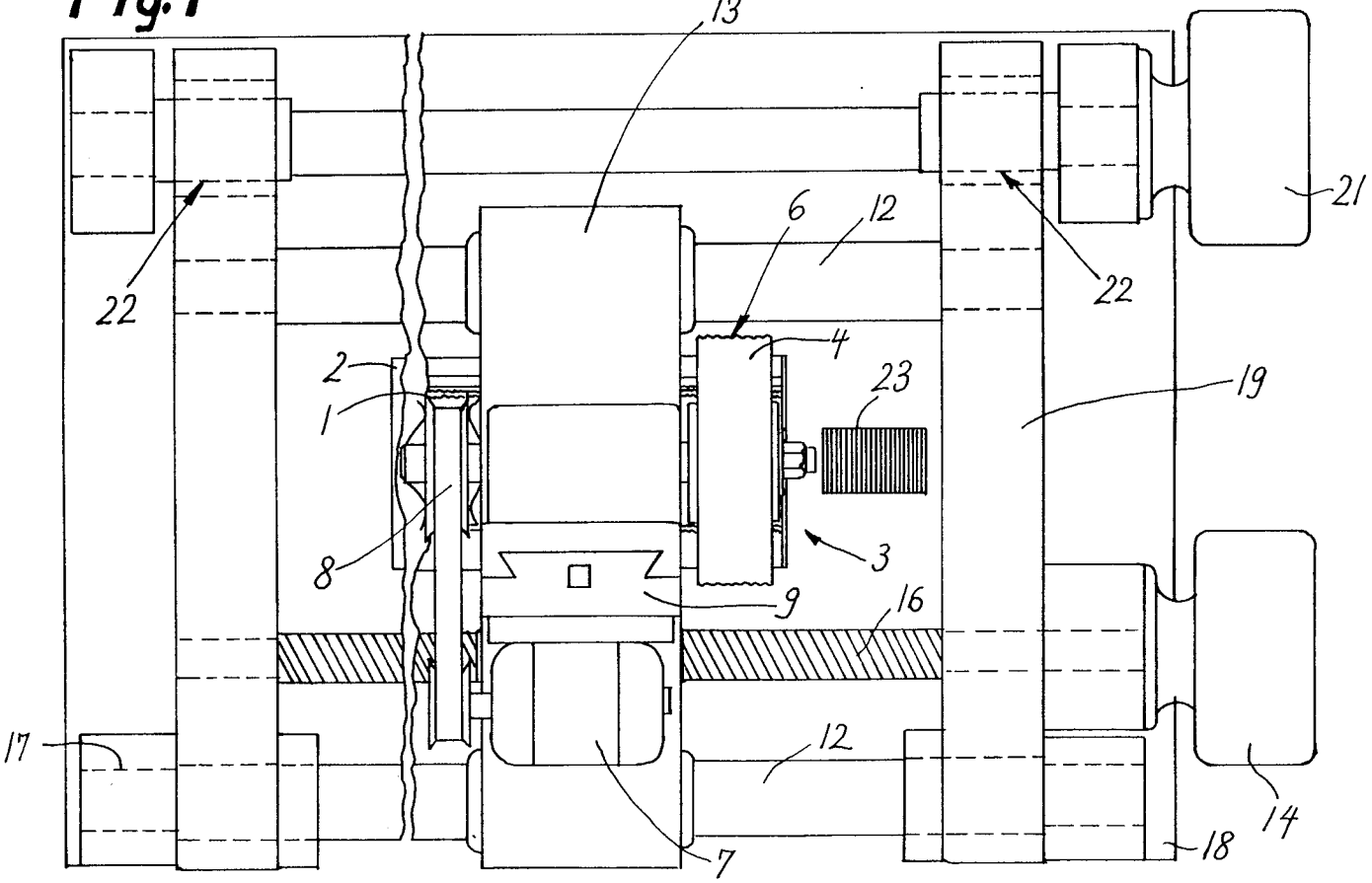
FIG. 1 is a rear elevational view of a portion of a tobacco cutting machine which embodies the invention.
Figure 2:
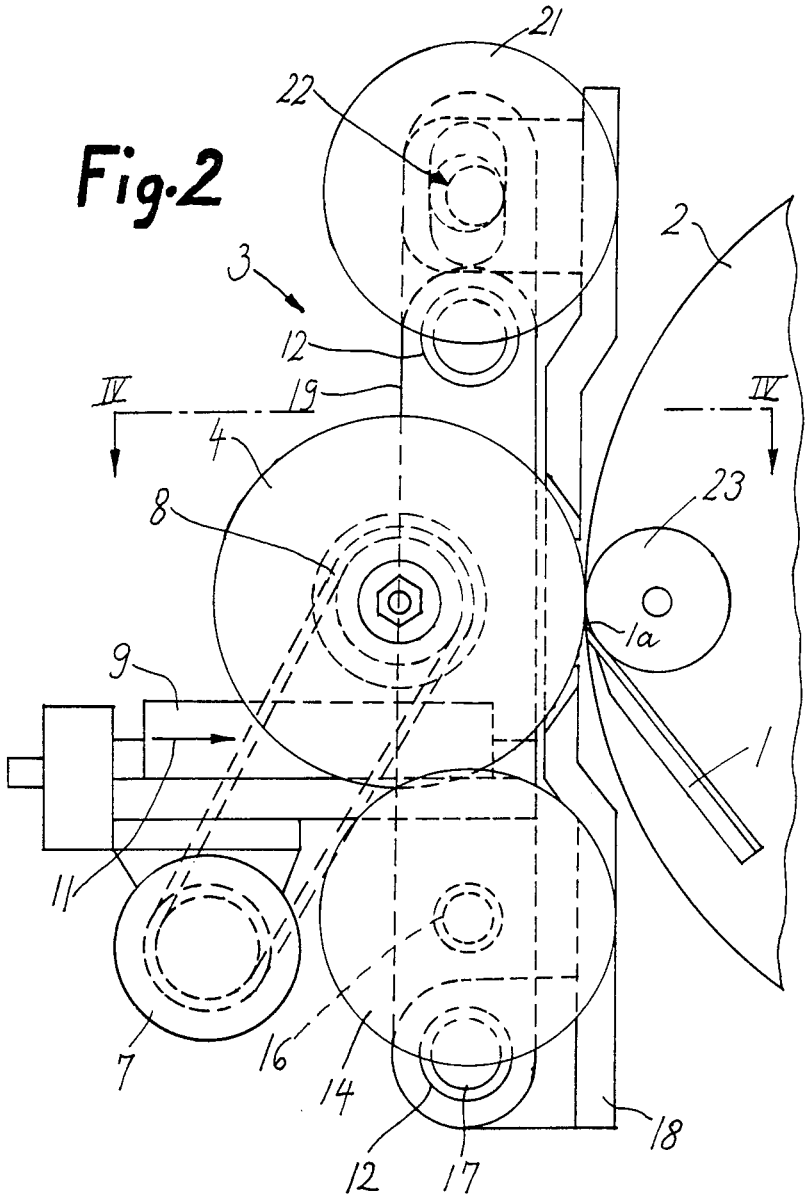
FIG. 2 is an enlarged fragmentary side elevational view of the structure which is shown in FIG. 1.

Referring first to FIGS. 1 and 2, there is shown a portion of a machine for cutting or shredding tobacco leaves and an apparatus which embodies one form of the present invention. The cutting machine comprises a rotary drum-shaped holder 2 which is rotatable about a horizontal axis and carries a set of equidistant elongated knives 1 each of which has an undulate (wavy) cutting edge 1*a*. A tobacco cutting machine which can be used in conjunction with or which can embody the improved knife grinding apparatus is disclosed, for example, in commonly owned U.S. Pat. No. 4,401,205 granted Aug. 30, 1983 to Werner Komossa et al.

The cutting zone where the cutting edges 1*a* of successive knives 1 on the rotating holder 2 sever the leader of a compacted cake of tobacco leaves is located to the right of FIG. 2. The improved grinding apparatus is adjacent to the left-hand side of the holder 2, as viewed in FIG. 2, i.e., diametrically opposite the cutting or shredding station of the machine. The grinding apparatus is denoted by the reference character 3 and comprises a relatively narrow grinding wheel 4 having an undulate profile 6 which is complementary to the profiles of cutting edges 1*a* on the knives 1. As can be seen in FIG. 1, the width (axial length) of the grinding wheel 4 is a small fraction of the length of the cutting edges 1*a*, i.e. of the axial length of the rotating holder 2. The latter is designed to orbit the cutting edges 1*a* along an endless circular path the center of which is located on the axis of rotation of the holder 2.

The grinding wheel 4 is driven by an electric motor 7 through the medium of an infinitely variably V-belt transmission 8.

The grinding apparatus 3 further comprises a carriage 9 which is movable with the grinding wheel 4, motor 7 and transmission 8 substantially radially of the holder 2 so as to move the profile 6 of the grinding wheel toward or away from the path of orbital movement of the cutting edges 1*a* and to thus compensate for wear upon the grinding wheel 6 and/or knives 1. The means for moving the carriage 9 is not shown. The direction in which the carriage 9 is movable substantially radially of the holder 2 is indicated in FIG. 2 by the arrow 11.

The reference characters 12 denote two horizontal guide members in the form of tie rods which reciprocably support a carriage 13 having a nut in mesh with a feed screw 16 which is rotatable by a reversible stepping motor 14. The feed screw 16, motor 14 and the carriage 13 constitute a means for stepwise advancing the grinding wheel 4 in parallelism with the axis of the holder 2, i.e., in substantial parallelism with the cutting edges 1*a* of the knives 1.

All of the heretofore described parts of the grinding apparatus 3 are mounted in a frame 19 which is pivotable about the axis of a horizontal shaft 17 mounted in a stationary housing 18 of the tobacco cutting machine. The means for pivoting the frame 19, with all of the parts mounted thereon, clockwise and counterclockwise, as viewed in FIG. 2, comprises two spaced-apart eccentrics 22 which are rotatable by a motor 21 and can rock the frame 19 back and forth about the axis of the shaft 17. The latter is parallel to the holder 2 and to the grinding wheel 4. The motor 21 is a stepping motor which can turn the eccentrics 22 in a single direction or back and forth.

The tobacco cutting machine which is shown in FIGS. 1 and 2 further comprises a dressing tool 23 in the form of a roller which is adjacent to one axial end of the holder 2 and has a width (axial length) which at least matches the axial length of the grinding wheel 4. Furthermore, the dressing tool 23 has a profile which is complementary to the profile 6 of the grinding wheel 4.

Figure 6:
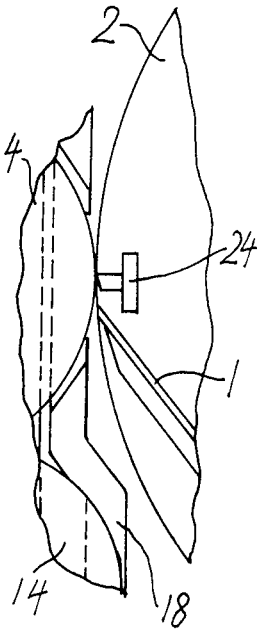
FIG. 6 is a fragmentary side elevational view of a modified machine which employs a different dressing tool.

In lieu of utilizing a roller-shaped dressing tool 23, the tobacco cutting machine can comprise a stationary block-shaped dressing tool 24 of the type shown in FIG. 6. The left-hand end face of the tool 24 has an undulate profile which is complementary to the profile of the grinding wheel 4. The stationary dressing tool 24 is mounted in the housing 18 or in another stationary part of the tobacco cutting machine adjacent to one axial end of the holder 2. The width of the stationary dressing tool 24, as considered at right angles to the plane of FIG. 6, preferably at least equals the axial length of the grinding wheel 4.

The arrangement is such that the profile 6 of the grinding wheel 4 is treated in the course of the grinding operation to thus ensure that the cutting edges 1*a* of the orbiting knives 1 are invariably treated in a manner to guarantee the making of clean cuts and the formation of long shreds which are likely to produce a satisfactory tobacco filler. The arrangement is preferably such that the cutting edges 1*a* are ground continuously as the cutting operation proceeds and that the profile 6 of the grinding wheel 4 is treated by the dressing tool 23 or 24 upon completion of each pass of the grinding wheel from one to the other axial end of the holder 2. Dressing of the profile 6 on the grinding wheel 4 can take place before or subsequent to completion of a sequence of grinding operations upon the cutting edges 1*a* of the knives 1 on the holder 2. In order to perform a dressing operation, it is necessary to cause the stepping motor 21 to turn the two eccentrics 22 through an angle of 180° so as to pivot the frame 19 and the grinding wheel 4 therein against the dressing roller 23 or against the dressing block 24. At such time, the profile 6 of the grinding wheel 4 is in register with the profile of the dressing tool 23 or 24 so that the entire profile 6 is dressed in a single operation because the width of the dressing tool 23 or 24, as considered in the axial direction of the holder 2 shown in FIG. 1, at least equals the axial length of the grinding wheel 4. The grinding wheel 4 is shown in the right-hand portion of FIG. 3 by solid lines in a position in which its profile 6 is being treated by the profile of the dressing tool 23. The movements of the grinding wheel 4 into and from register with the dressing tool 23 are effected by the stepping motor 14 and its feed screw 16 through the medium of the carriage 13. The movements of the grinding wheel 4 into and from actual contact with the dressing tool 23 are effected by the stepping motor 21 and the eccentric discs 22 which can pivot the frame 19 about the axis of the shaft 18.

Figure 3:
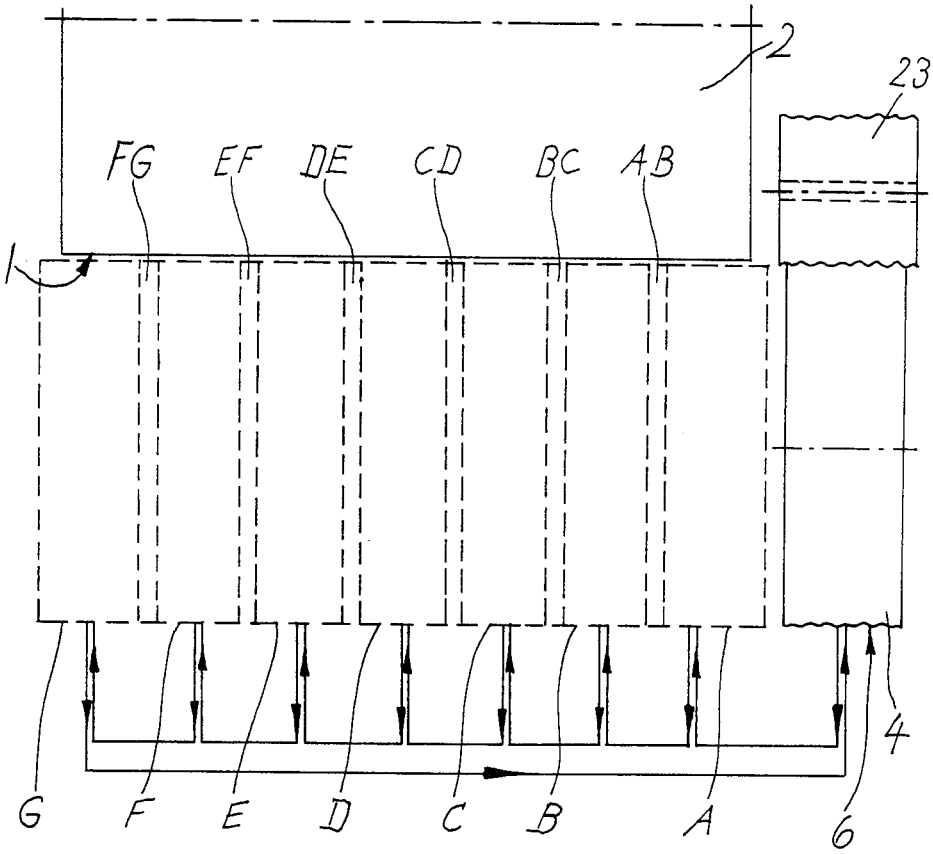
FIG. 3 is a schematic plan view of the holder for a set of orbiting knives and of the grinding wheel, various operative positions of the grinding wheel being indicated by broken lines.

When the dressing of the profile 6 on the grinding wheel 4 is completed, the motor 21 is again caused to pivot the frame 19 through the medium of the eccentrics 22 so that the profile 6 is moved away from the profile of the tool 23 and the stepping motor 14 is thereupon actuated to rotate the feed screw 16 in a direction to move the carriage 13 and the grinding wheel 6 to a first grinding position A which is indicated by broken lines in the right-hand portion of FIG. 3. The motor 21 is thereupon again actuated to turn the eccentrics 22 through 180° so as to move the grinding wheel 4 (in the broken-line position A) into actual contact with the adjacent portions of cutting edges 1*a* of the orbiting knives 1 on the rotating holder 2. When the grinding of the corresponding portions of the cutting edges 1*a* is completed, the stepping motor 21 is actuated again to pivot the frame 19 through the medium of the eccentrics 22 so that the profile 6 is moved out of contact with the cutting edges 1*a*, and the motor 14 is thereupon caused to move the grinding wheel 4 through the medium of the feed screw 16 and carriage 13 to the second grinding position B which is shown in FIG. 3 by broken lines and in which a portion of the profile 6 overlaps the previously ground portions of the cutting edges 1*a*. The zone of overlap is shown at AB. Such partial overlap between the previously treated and still untreated portions of the cutting edges 1*a* of the knives 1 ensures that each and every portion of each cutting edge 1*a* is properly treated by the profile 6 before the grinding wheel 4 completes its stepwise advance from the one to the other axial end of the holder 2.

The grinding wheel 4 is thereupon moved to the grinding positions C, D, E, F and G of FIG. 3 with corresponding zones of overlap BC, CD, DE, EF and FG between successive previously treated and still untreated portions of the cutting edges 1*a*. The provision of zones of overlap AB-FG ensures that each and every portion of each cutting edge 1*a* is adequately treated during each pass of the grinding wheel 4 from the right-hand to the left-hand axial end of the holder 2 shown in FIG. 3. The number of grinding positions can be increased to more than seven or reduced to less than seven without departing from the spirit of the invention. Furthermore, the extent to which successive grinding positions of the grinding wheel 4 overlap can also be changed, i.e., such extent can be reduced to a fraction of one millimeter or increased to several millimeters. When the last grinding operation (in the broken-line position G of the grinding wheel 4 shown in FIG. 3) is completed, the motor 21 pivots the frame 19 in a counterclockwise direction, as viewed in FIG. 2, so as to move the grinding wheel 4 away from the endless circular path of orbital movement of the cutting edges 1*a*, and the stepping motor 14 is caused to return the grinding wheel 4 into register with the dressing tool 23 or 24, i.e., to the solid-line position shown in the right-hand portion of FIG. 3. The profile 6 is thereupon dressed by the profile of the dressing tool 23 or 24 before the grinding operation is resumed in the aforedescribed manner, i.e., the grinding wheel 4 is first caused to assume the position A, then the position B, and so forth.

Figure 4:
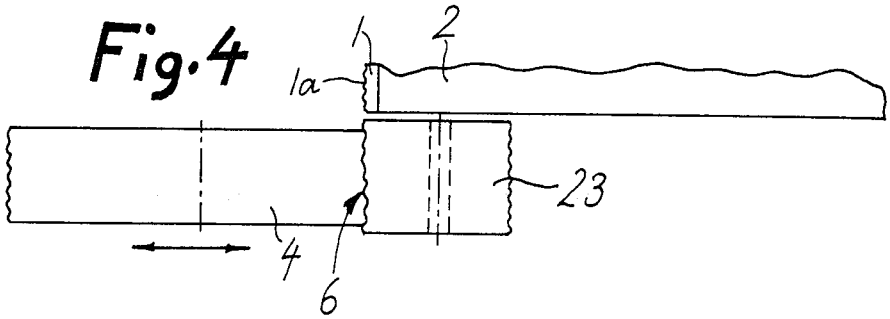
FIG. 4 is a fragmentary plan view substantially as seen in the direction of arrows from the line IV—IV of FIG. 2.

FIG. 4 is a fragmentary plan view of the right-hand portion of the structure which is shown in FIG. 3. It shows the profile 6 of the grinding wheel 4 in contact with the profile of the dressing tool 23. It also shows that the dressing tool 23 is adjacent to one axial end of the holder 2 in such a way that its undulate profile has a portion in line with the undulate cutting edges 1*a* of successive knives 1 on the rotating holder 2.

Figure 5:
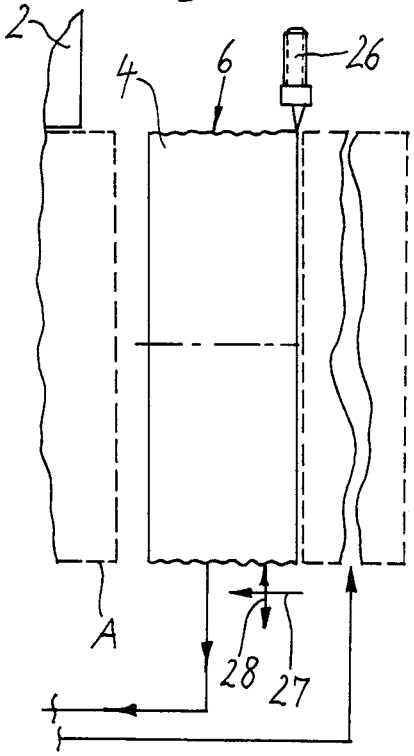
FIG. 5 is a diagrammatic plan view of a grinding wheel which is in the process of being dressed by a stationary diamond.

FIG. 5 illustrates a portion of a modified grinding and dressing apparatus wherein the dressing tool 23 or 24 is replaced with a stationary dressing diamond 26. This diamond is adjacent to one axial end of the holder 2 and can treat the profile 6 of the grinding wheel 4 when the latter is moved to a position corresponding substantially to the solid-line position shown in the right-hand portion of FIG. 3. At such time, the motors 14 and 21 are caused to respectively advance the grinding wheel 4 axially and to move or displace the grinding wheel 4 toward and away from the dressing diamond 26 so that the tip of the diamond 26 treats the profile 6 starting at one axial end and ending at the other axial end of the continuously rotating grinding wheel 4. The directions in which the grinding wheel is being moved by the motor 21 during dressing are indicated by the double-headed arrow 28, and the direction in which the motor 14 advances the grinding wheel 4 in the course of the dressing operation is indicated by the arrow 27. Dressing of the profile 6 takes place upon completion of each of a series of grinding operations during which the grinding wheel 4 moves from the position A to the position G before returning into register with the diamond 26. It is clear that the extent to which the eccentrics 22 pivot the frame 19 in order to move the grinding wheel 4 in the directions indicated by the double-headed arrow 28 of FIG. 5 is a small fraction of the extent of pivotal movement of the frame 19 for the purposes of moving the grinding wheel 4 to and from successive grinding positions A, B, C, D, E, F and G. In other words, at such times, the eccentrics 22 need not be rotated through full 180°. The extent of angular movement of the frame 19 under the action of the motor 21, when the profile 6 of the grinding wheel 4 is being dressed by the diamond 26, depends on the depth of valleys between the ridges of the profile 6 of the grinding wheel.

Figure 7:
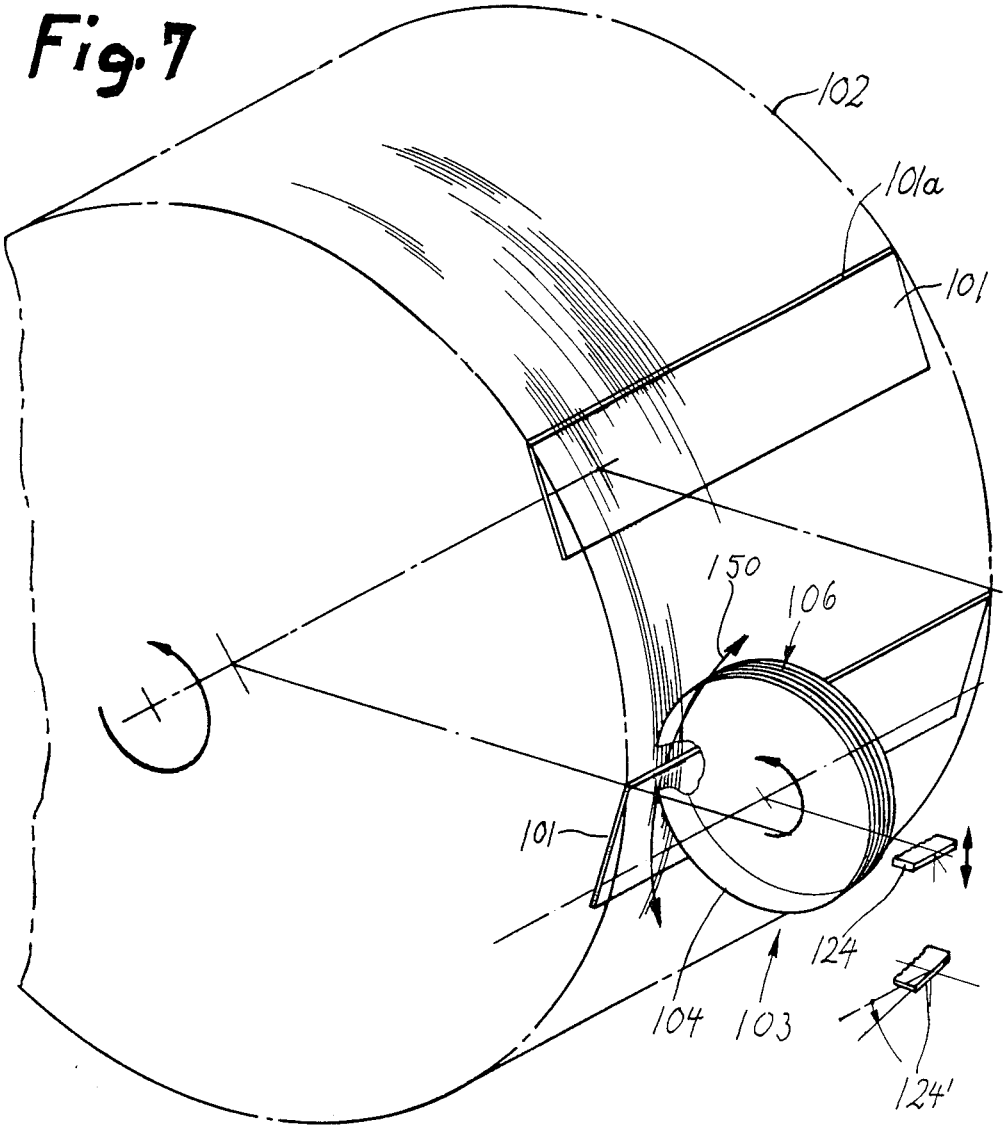
FIG. 7 is a fragmentary perspective view of a further machine which utilizes a differently mounted grinding wheel.

FIGS. 7 to 10 illustrate a modified grinding and dressing apparatus 103 which serves to grind the undulate cutting edges 101*a* of knives 101 on a rotary holder 102 forming part of a tobacco cutting or shredding machine. All such parts of this apparatus which are identical with or clearly analogous to the corresponding parts of the apparatus shown in FIGS. 1 and 2 are denoted by the same characters plus 100. As can be seen in FIG. 7, the length of the cutting edge 101*a* of each knife 101 on the holder 102 is many times the axial length of the grinding wheel 104 which has an undulate profile 106 complementary to the undulate profiles of the cutting edges 101*a*. The grinding wheel 104 is located diametrically opposite that portion of the holder 102 where the cutting edges 101*a* of successive knives 101 remove shreds or otherwise configurated particles from the leader of a continuous compacted tobacco cake.

The grinding wheel 104 is driven by a motor 107 through the medium of an infinitely variable V-belt transmission 108. A carriage 109 is provided to support the motor 107, the transmission 108 and the grinding wheel 104 for movement substantially radially of the holder 102 in order to compensate for wear upon the grinding wheel. The direction in which the carriage 109 can move the grinding wheel radially of the holder 102 is indicated by the arrow 111. The means for advancing the grinding wheel 104 in parallelism with the axis of the holder 102 comprises horizontal tie rods 112 which are parallel to the axis of the holder and are mounted in a frame 119. The tie rods 112 reciprocably guide a carriage 113 which supports the motor 107, transmission 108 and grinding wheel 104 and is reciprocable in parallelism with the axis of the holder 102 by a stepping motor 114 through the medium of a horizontal feed screw 116. The frame 119 is pivotable about the axis of the shaft 117 relative to a stationary housing 118 of the tobacco cutting machine.

The grinding wheel 104, the motor 107, the transmission 108 and the carriage 109 are mounted on a carrier 129 which is pivotable about the axis of a horizontal shaft 131. The shaft 131 is supported by two spaced-apart arms 132, 133 which are secured to the carriage 113 and carry a plate-like platform 136 for a stepping motor 136 serving to pivot the carrier 129 about the axis of the shaft 131. A feed screw 137 which is driven by the motor 136 meshes with a nut 138 which is located in an elongated slot 139 of the carrier 129.

The grinding apparatus 103 further comprises a dressing tool 123 which is adjacent to one axial end of the holder 102 and has a profile that is complementary to the profile 106 of the grinding wheel 104. The width of the dressing tool 123, as considered in the axial direction of the holder 102, at least equals the axial length of the grinding wheel 104. As shown in FIG. 7, the rotary wheel-shaped dressing tool 123 of FIGS. 9 and 10 can be replaced with a block- or plate-like dressing tool 124 having a profile which is complementary to the undulate profile 106 of the grinding wheel 104. The plate-like dressing tool 124 can be mounted in a plane which includes the axis of the grinding wheel 104, or it can be mounted with reference to the plane of the axis of the grinding wheel at an acute angle (this is shown at 124′ in the lower right-hand portion of FIG. 7). The mounting of the dressing tool in a manner as shown at 124′ renders it possible to effect small changes in the profile 106 of the grinding wheel 104 if such changes are necessary.

Figure 8:
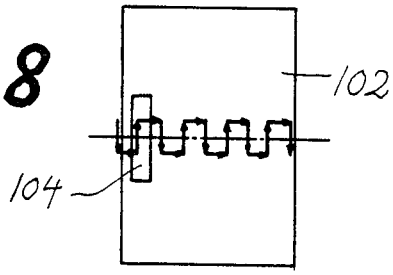
FIG. 8 is a diagrammatic view showing the manner of shifting the grinding wheel of FIG. 7 relative to the undulate cutting edges of orbiting knives on the rotary holder of the tobacco cutting machine.
Figure 9:
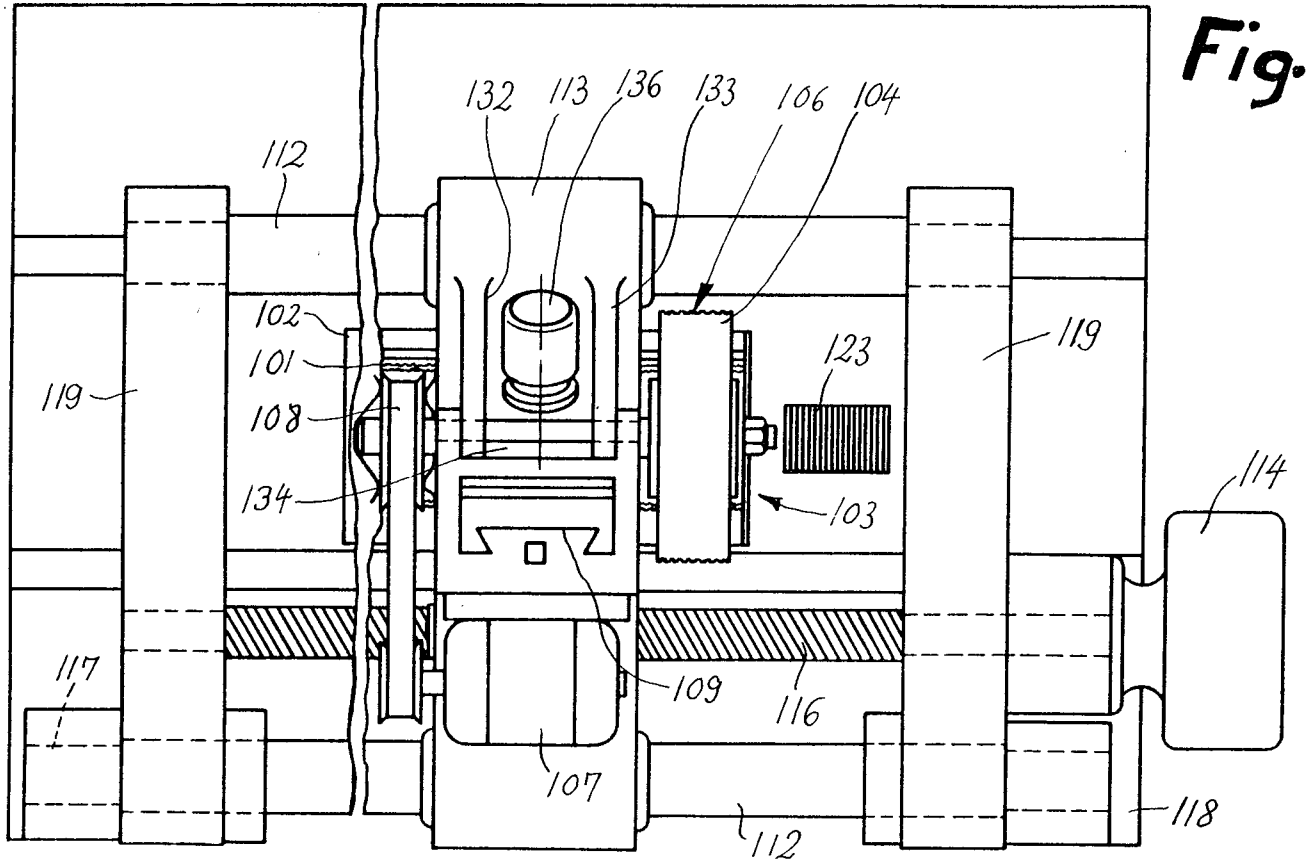
FIG. 9 is a fragmentary rear elevational view of the tobacco cutting machine which embodies the structure of FIGS. 7 and 8.
Figure 10:
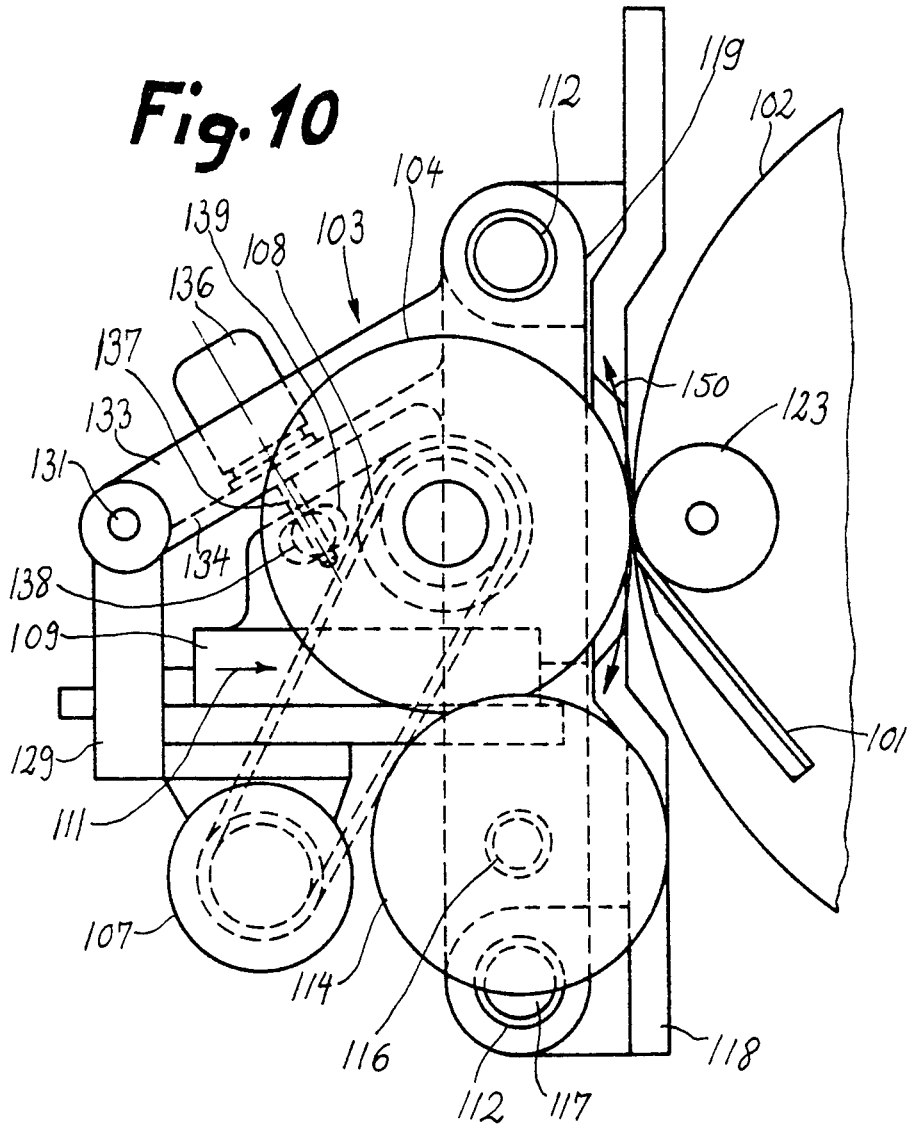
FIG. 10 is an enlarged fragmentary side elevational view of the structure which is shown in FIG. 9.

When the grinding apparatus 103 of FIGS. 7 to 10 is in actual use, the undulate profiles of the cutting edges 101*a* of knives 101 on the holder 102 are continuously ground by the profile 106 of the grinding wheel 104, and the profile 106 is dressed upon completion of each of a series of successive grinding operations, namely upon completed grinding of the entire cutting edges 101*a*. The dressing operation is carried out as follows: When the grinding wheel 104 reaches its first or last grinding position (corresponding to the position A or G of FIG. 3), the motor 136 is started to pivot the carrier 129 about the axis of the shaft 131 along an arcuate path and downwardly, as viewed in FIG. 10, so that the grinding wheel 104 moves substantially tangentially of the dressing tool 123 and its profile 106 moves into engagement with the complementary profile of the dressing tool. The movements of the grinding wheel 104 under the action of the motor 136 are indicated by arcuate arrows 150. When the rightmost portion of the profile 106 (as viewed in FIG. 10) moves downwardly and below the level of the leftmost portion of the profile on the dressing tool 123, the stepping motor 114 is started so that the feed screw 116 moves the grinding wheel in parallelism with the axis of the holder 102 until the grinding wheel reaches the first grinding position corresponding to the position A of FIG. 3. The motor 136 is thereupon operated in reverse so as to move the grinding wheel 104 upwardly, as viewed in FIGS. 8 and 10, so that the grinding wheel moves along an arcuate path (arrows 150) and upwardly and moves tangentially into contact with the cutting edges 101*a* of the knives 101 on the holder 102 with the result that the adjacent portions of the cutting edges are ground by the profile 106. When the grinding wheel 104 reaches its uppermost position and is out of contact with the cutting edges 101*a*, the motor 114 is started again to shift the grinding wheel axially in parallelism with the holder 102 to the next grinding position (corresponding to the position B of FIG. 3) and the motor 136 is thereupon caused to pivot the carrier 129 about the axis of the shaft 131 with the result that the grinding wheel 104 treats the adjacent portions of the cutting edges 101*a*. As shown in FIG. 8, grinding of the cutting edges 101*a* takes place while the grinding wheel alternatingly moves upwardly or downwardly, i.e., while the carrier 129 respectively pivots clockwise and counterclockwise. As described in connection with FIG. 3 for the grinding wheel 4, the extent of axial movement of the grinding wheel 104 under the action of the motor 114 is preferably such that the freshly treated portions of the cutting edges 101*a* are partially overlapped by the profile 106 when the grinding wheel 104 returns into tangential grinding engagement with the knives 101. Such partial overlaps ensure complete grinding of the entire cutting edges 101*a* while the grinding wheel 104 advances stepwise from the one to the other axial end of the holder 102. When the grinding wheel 104 has completed a full series of grinding operations, it is moved away from the holder 102 and is caused to perform a return stroke in parallelism with the axis of the holder 102 and into register with the dressing tool 123, 124 or 124'. The dressing operation is again followed by a sequence of grinding operations in a manner as described above, i.e., the grinding wheel is caused to travel along the arcuate path 150 to grind the cutting edges 101*a* first while it moves upwardly, thereupon while it moves downwardly, again while it moves upwardly, and so forth. Such upward and downward movements alternate with stepwise advances under the action of the motor 114 and feed screw 116.

It is clear that the dressing tool 123, 124 or 124' can be replaced with a dressing tool of the type shown at 26 in FIG. 5 without departing from the spirit of the invention.

An advantage of the apparatus which is shown in FIGS. 7 to 10 is that the grinding wheel 104 is in longer-lasting grinding engagement with the knives 101 than the grinding wheel 4 with the knives 1.

Another advantage of the apparatus which is shown in FIGS. 7 to 10 is that the grinding wheel 104 need not be moved away from the path of the cutting edges 101*a* after each grinding operation because such movement away from the path of cutting edges 101*a* takes place automatically as a result of movement of the grinding wheel along the arcuate path which is indicated by the arrow 150, i.e., tangentially of the periphery of the holder 102.

An additional advantage of the improved machine and of the improved dressing and grinding apparatus is that the apparatus is simple, inexpensive and compact but highly reliable. Furthermore, dressing of the grinding wheel 4 or 104 takes up little time so that the grinding wheel can be used for the treatment of the cutting edges 1*a* or 101*a* practically without interruptions.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of grinding the elongated undulate cutting edge of a knife, which orbits along an endless path about a predetermined axis in a tobacco cutting machine, by means of a rotary grinding wheel which is movable relative to the orbiting knife and has a profile that is complementary to that of the cutting edge, comprising the steps of advancing the grinding wheel stepwise relative to the orbiting knife longitudinally of the cutting edge; and moving the profile of the grinding wheel into contact with different portions of the cutting edge between stepwise advances of the grinding wheel.

2. The method of claim 1, wherein said advancing step includes shifting the grinding wheel in at least substantial parallelism with the predetermined axis.

3. The method of claim 1, wherein said moving step includes moving the grinding wheel toward and away from the orbiting knife at least substantially at right angles to the predetermined axis.

4. The method of claim 1, wherein said moving step includes moving the grinding wheel substantially tangentially of the endless path.

5. The method of claim 1, wherein each of said moving steps includes placing the grinding wheel into material removing contact with a previously ground portion and an untreated portion of the cutting edge.

6. The method of claim 5, wherein the extent of overlap between a previously ground portion of the cutting edge and the grinding wheel is at least substantially the same upon completion of each of said moving steps.

7. The method of claim 1, further comprising the steps of dressing the grinding wheel during the intervals between selected movements into contact with the cutting edge.

8. The method of claim 7, wherein each of said dressing steps precedes a selected one of said advancing steps.

9. The method of claim 7, wherein each of said dressing steps follows a selected one of said advancing steps.

10. The method of claim 7, wherein each of said dressing steps includes contacting the profile, along the full axial length of the grinding wheel, with the complementary profile of a dressing tool during each of said intervals.

11. The method of claim 7, wherein each of said dressing steps includes continuously moving the grinding wheel relative to a dressing tool.

12. In a machine for cutting tobacco or the like, the combination of a holder rotatable about a predetermined axis; at least one knife mounted on said holder for orbital movement along an endless path about said axis and having an elongated undulate cutting edge extending in at least substantial parallelism with the predetermined axis; and means for grinding said cutting edge, including a rotary grinding wheel having an undulate profile complementary to that of said cutting edge, means for advancing said grinding wheel stepwise longitudinally of said cutting edge, and means for moving said grinding wheel into and from contact with said cutting edge between intermittent advances of the grinding wheel longitudinally of said cutting edge.

13. The combination of claim 12, wherein said advancing means includes means for advancing the grinding wheel in at least substantial parallelism with the predetermined axis.

14. The combination of claim 12, wherein said moving means comprises a frame for said grinding wheel and means for displacing said frame at least substantially at right angles to the predetermined axis.

15. The combination of claim 14, wherein said displacing means comprises means for pivoting said frame.

16. The combination of claim 14, wherein said displacing means comprises an eccentric drive.

17. The combination of claim 12, wherein said moving means comprises means for moving said grinding wheel substantially tangentially of the endless path.

18. The combination of claim 17, wherein said advancing means comprises a reciprocable carriage and said moving means comprises a carrier for said grinding wheel, said carrier being mounted on said carriage for pivotal movement about a second axis which is at least substantially parallel to the predetermined axis.

19. The combination of claim 12, wherein said advancing means comprises a feed screw and means for rotating said feed screw.

20. The combination of claim 12, further comprising means for dressing said grinding wheel while the latter is out of contact with said cutting edge.

21. The combination of claim 20, wherein said dressing means is adjacent to one axial end of said holder.

22. The combination of claim 20, wherein said dressing means comprises a tool having a length which at least matches the axial length of said grinding wheel so that all increments of the profile of said grinding wheel can be dressed in a simultaneous operation.

23. The combination of claim 22, wherein said dressing means comprises a stationary dressing tool.

24. The combination of claim 20, wherein said dressing means comprises a diamond.

25. The combination of claim 24, wherein said diamond is stationary and at least one of said advancing and moving means is arranged to move said grinding wheel relative to said diamond.

* * * * *